US005753086A

United States Patent [19]

Guffey et al.

[11] Patent Number: 5,753,086

[45] Date of Patent: May 19, 1998

[54] PROCESS FOR WASTE PLASTIC RECYCLING

[75] Inventors: Frank D. Guffey; Floyd Alan Barbour, both of Laramie, Wyo.

[73] Assignee: The University of Wyoming Research Corp., Laramie, Wyo.

[21] Appl. No.: 525,639

[22] PCT Filed: Mar. 8, 1994

[86] PCT No.: PCT/US94/02433

§ 371 Date: Sep. 6, 1995

§ 102(e) Date: Sep. 6, 1995

[87] PCT Pub. No.: WO94/20590

PCT Pub. Date: Sep. 15, 1994

[51] Int. Cl.[6] ..... C10B 9/00; B01D 1/00; C10G 7/00

[52] U.S. Cl. ..... 202/88; 202/94; 202/96; 202/108; 202/111; 196/98; 196/116; 196/123

[58] Field of Search ..... 422/184, 261, 422/232, 285, 286, 289, 307, 309; 110/346, 347, 235, 255; 208/415; 44/280, 281; 201/8, 25, 28; 196/98, 116, 123; 202/84, 108, 88, 111, 94, 96; 585/241

[56] References Cited

U.S. PATENT DOCUMENTS

| | | | |
|---|---|---|---|
| 3,700,615 | 10/1972 | Scott | 260/2.3 |
| 3,945,810 | 3/1976 | Saito | 48/76 |
| 4,417,529 | 11/1983 | Fujimoto et al. | 110/346 |
| 4,584,421 | 4/1986 | Saito et al. | 201/2.5 |
| 4,657,400 | 4/1987 | Suehisa et al. | 366/144 |
| 5,226,926 | 7/1993 | Matsuzaki | 44/530 |
| 5,368,723 | 11/1994 | Takahashi et al. | 208/427 |
| 5,584,969 | 12/1996 | Nagi et al. | 196/116 |
| 5,597,451 | 1/1997 | Nagai et al. | 201/4 |
| 5,608,136 | 3/1997 | Maezawa et al. | 588/228 |

FOREIGN PATENT DOCUMENTS

| | | |
|---|---|---|
| 0 132 612 A1 | 3/1985 | European Pat. Off. . |
| 25 30 229 | 6/1977 | Germany . |
| WO 88/08020 | 10/1988 | WIPO . |

OTHER PUBLICATIONS

"Tar Sand Pyrolysis with Product Oil Recycling–Progress Report", C.Y. Cha, F.D. Guffey, and L.J. Romanowski, Jr. Sep. 1987, Laramie, Wyo., DOE Report DOE/MC/11076–2642.

Eastern Oil Shale Conversion Using the ROPE Process, C.Y. Cha, L.J. Fahy, F.D. Guffey, Sep. 1988, Laramie, Wyo.; Work performed under DE–FC21 86MC11076.

Laboratory Simulation Studies of the Recycle Oil Pyrolysis and Extraction Concept, F. D. Guffey and D. E. Hunter, Aug. 1989, Laramie, WY, DOE Report DOE/MC11076–3032.

"Studies on Thermal Decomposition of Plastic Wastes II—Pyrolysis of Plastic Wastes by The Solvent Method", Journal of the Fuel Society of Japan, 53, 715–725, O. Inomata, H. Ando, T. Abe, 1974 (Provided in Japanese language with English data and and English synopsis).

"Solid Waste Concerns Spur Plastic Recycling Efforts", Chemical and Engineering News, Jan. 30, 1989, 7–15, A.M. Thayer.

"Preliminary Results of Tar Sand Pyrolysis with Product Oil Recycling", by Cha, et al., Sep. 1986 for U.S. Department of Energy pp. 1–27.

(List continued on next page.)

*Primary Examiner*—Nina Bhat
*Attorney, Agent, or Firm*—Luke Santangelo

[57] ABSTRACT

An apparatus for recycling or decompstiong waste plastic is decomposed in a diluent such as hot oil through actions involving free readical precursors, such as polyvinyl chloride or polyurethane is achieved at low temperatures. The thermal decompostion (or pyrolysis) reaction is for about 1 hour at 375° C. annd usable products, such as distillate, coke and oil are recovered. Additonally the diluent my ber recycled within the apparatus.

11 Claims, 1 Drawing Sheet

OTHER PUBLICATIONS

Figure 1:
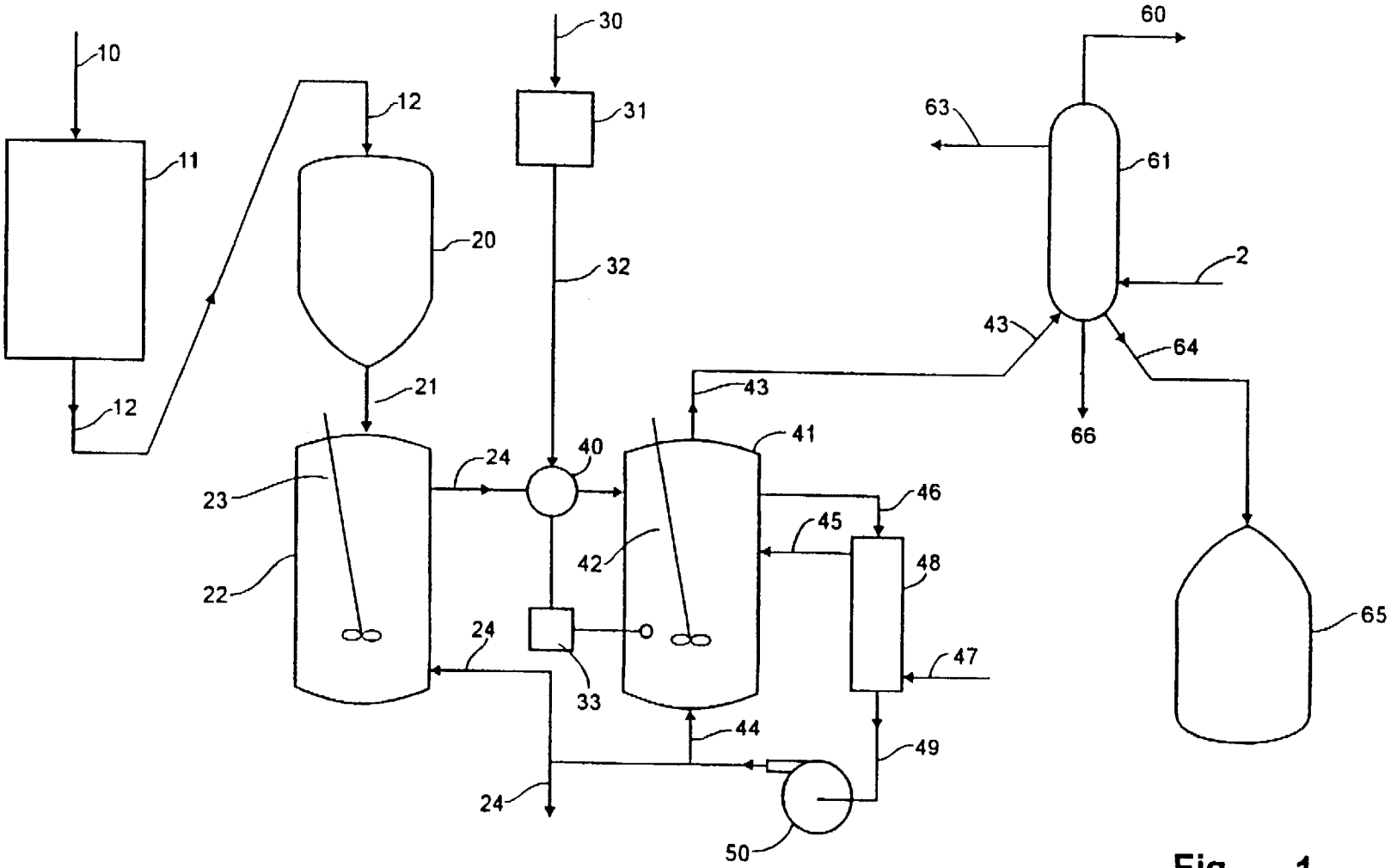

"Procedyne Waste Pyrolysis Process", by Gary Balsam, presented at the Joint Seminar sponsored by Procedyne Corp., U.S. Dept. Of Energy and U.S. Chemicals on Jul. 15, 1982 at Pasadena, Texas, pp. 52–60.

"Pyrolysis of Rubber Wastes in Heavy Oils and use of the Products", by Bouvier, et al., published in Resources and Consesrvation in 1986, pp. 77–93.

"Thermogravimetric and Free Radical Evidence for Improved Liquefaction of Coal with Waste Tires", Ibrahim, et al., American Chemical Society, Division of Fuel Chemistry, vol. 38, No. 3, Aug. 1993, pp. 840–847.

"The Depolymerization of Polymethylene and Polyethylene", by Wall, et al., pp. 3430–3437, Jul. 5, 1954.

"Coal and Oil/Resid Coprocessing Symposium", Coprocessing of Hydrocarbonacous Waste and Residual Oil—A Novel Approach to Recycling, Anderson, et al., American Chemical Society Preprints, Division of Petroleum Chemistry, Inc., pp. 335–338, Apr. 1993.

"Thermal Recycling of Polymers", Journal of Analytical and Applied Pyrolysis, by W. Kaminsky, pp. 439–448, 1985.

"Catalytic Decomposition of Polyethylene Using A Tubular Flow Reactor System", vol. 69 FUEL Aug. 1990, pp. 978–984, by Ishihara et al.

"Value Recovery from Polymer Wastes by Pyrolysis", vol. 18 Polymer Engineering and Science July 1978, pp. 721–727, by Roy et al.

"Fast Pyrolysis of Plastic Wastes", vol. 4, No. 4 Energy and Fuels 1990, by Scott et al., pp. 407–411.

Plastics Recycling, R.J. Ehrig, Editor, pp. 1–16, 178–183.

"Summary of Laboratory Simulation Studies of the ROPE® Process", pp. 1–79, Dec. 1991, by Guffey et al., Reported to the U.S. Dept. Of Energy Office of Fossil Energy.

"Laboratory Simulation Studies of Steady–State and Potential Catalytic Effects in the ROPE® Process", Reported to the U.S. Dept. Of Energy, Office of Fossil Energy.

PROCESS FOR WASTE PLASTIC RECYCLING

This is a national stage application of PCT/US94/02433, filed Mar. 8, 1994.

I. TECHNICAL FIELD

The present invention relates generally to processes for low temperature thermal decomposition of waste plastics. Specifically, the invention focuses upon achieving decomposition of waste plastics at a lower temperature than was previously possible. In particular municipal, health and industrial waste plastics are processed such as (but not limited to) polyethylene (PE), polypropylene (PP), polystyrene (PS), polyethylene terephthalate (PET), polyurethane (PU), and polyvinyl chloride (PVC).

II. BACKGROUND ART

Waste plastics, that is synthetic polymer-containing substances, pose an environmental issue because of the problems associated with disposal: a large volume of non-biodegradable material. Because of the limits on landfill capacity, future recycling or decomposition is a necessity. Direct recycling back to the manufacture is not always feasible because such waste plastic is often mixed with respect to polymer type and separation is uneconomical. Economical considerations for processing waste plastic often require the use of the unseparated mixed waste plastic. Plastic recycling originated with the manufacture of synthetic thermoplastics. Rejected parts, trim, and flash from operations represented valuable materials that were ground and recycled with virgin material. This process was potentially repeated a number of times provided the percentage of regrinds remained low. As long as the plastic scrap generated by the industry was clean and uncontaminated with other plastics, reprocessing within the industry continued to expand, provided the price of virgin plastic remained high. After 1960 with a decrease in prices, profit margins for plastic scrap were squeezed, and disposal instead of reprocessing often occurred.

After 1970, plastic prices rose again due to OPEC raising the cost of petroleum feedstocks and recycling practices again increased. Interest increased not only in processes for reclaiming waste plastics, such as product evaluation for chemicals and fuels, but also in the necessary step of separation of plastics from other waste material. A review of this early history of plastics recycling is given by R. J. Ehrig in Plastics Recycling, Oxford University Press, N.Y., 1992, hereinafter referred to as Ehrig (1992). Some of the early operating plants for recycled plastic included a Department of Energy funded plant in LaPorte, Tex., which used a fluidized bed of sand and was designed for 17 million pounds per year of atactic polypropylene. It ran from 1980–82. In 1984 at Ebenhausen, Germany, a 20 million pound per year plant used molten salt with a fluidized bed reactor to process plastic wastes and tires.

In all cases economics governed whether such plants continued operation. Since 1985 plastics recycling has become more economically feasible due to continued plastics technological growth and increased environmental concern, however, significant cost impacts remain due to the level of the elevated temperatures previously required.

III DISCLOSURE OF INVENTION

The present invention relates to a process which overcomes the above-mentioned deficiencies in the prior art and to a process which achieves decomposition of waste plastic at a relatively low temperature. As one example, the process decomposes a mixed stream of waste plastic at a temperature generally less than 375° C. in a hot oil medium. The process converts the polymeric structure of the waste plastic or plastics to smaller chemical molecules such as the monomeric units and related chemical structures at a relatively lower temperature. It also serves the market for the such products. Since this market is not a to-be-developed manufacturing process, but rather one for which existing plants in the refining and petrochemical industries already exist, the process is adaptable to existing facilities that are already experiencing limited supplies of low molecular weight, heteroatomic free feedstocks from petroleum crude oils. The low-molecular weight distillate from waste plastic processing according to this invention may help reduce the demand for imported petroleum products and help decrease our dependence on foreign crude oil.

Basically the process is one in which the materials to be reacted are added or controlled so as to assure the existence of sufficient or appropriate amounts of free radicals. These free radicals are included to initiate free radical chain depolymerization reactions known to "unzip" polymer structures. To avoid recombination and to further enhance the process, this reaction is accomplished in a diluent such as an oil.

IV. BRIEF DESCRIPTION OF THE DRAWING

FIG. 1 shows a schematic diagram of a system for processing recycled waste plastic according to one technique of the present invention.

V. BEST MODE FOR CARRYING OUT THE INVENTION

The subject invention processes or decomposes mixed waste plastic at a relatively very low temperature. It may use thermal degradation in an oil media. Typical thermal degradation of waste plastics, such as that associated with municipalities waste, has previously required 400°–600° C. Through the present invention, this may occur at below about 375° C. This represents a saving of energy requirements and capital costs. In basic form, the invention is a process for the low-temperature thermal decomposition of waste plastics by a free radical mechanism at temperatures below 375° C. This may be accomplished in a diluent such as oil. This diluent does not significantly impact the action of the free radicals, serves to maintain energy levels, reduce chemical interaction, and serves as a diluent so as to avoid recombination of reactive products. As those skilled in the art could readily ascertain, the free radicals are neutral, unpaired electron shell substances which initiate the process and may be provided by a free radical precursor. These precursor substances are essentially all substances capable of providing free radicals at the condition chosen for the reactant. As those skilled in the art would also readily understand, they may include certain plastic resins (ie. polyvinyl chloride, polyurethane, and most likely nylon 66) and almost any other materials which produce the free radicals, such as those materials containing carbon-carbon, carbon-nitrogen, carbon-oxygen, or carbon-sulphur bonds as well some other compounds which may be free radical initiators and which do not volatilize too quickly in the reacting conditions chosen. The free radical precursors may exist as part of the waste plastic, may be a separately added substance, or may even be added to the diluent. The low-temperature activity of the present invention is believed to be attributed to the free radical chain depolymerization reactions known to "unzip" synthetic polymer structures. The free radical(s) liberated from polyvinyl chloride or from other sources at temperatures below 375° C. act as initiators to start the process. In an oil, free radicals from the initiator attack the polymer structure to satisfy their electronic structures. This results in the abstraction of a proton from the polymer molecule which initiates the free radical process in the polymer chain to break the structure into smaller molecules. The result is decomposition of the plastic at temperatures lower than previously expected. The resultant products are likely to be a distillate, coke, noncondensable hydrogen, and other gases.

In establishing the preferred embodiment of the invention, it is believed that there are three important conditions for low-temperature thermal decomposition of such plastics to occur. First, the plastic may need to be diluted in a diluent such as an oil solution to prevent recombination reactions. Second, if the free radical initiators are generated from the waste plastic, the plastics composition must contain resin types, such as polyvinyl chloride, that decompose at temperatures below 375° C. to generate free radicals. Third, even though the initiator concentration must be low, in a continuous process, it appears necessary to maintain the level at a critical concentration of about 0.5% (wt) to maintain the reaction.

As mentioned, the oil is believed to serve a variety of functions. In addition to those previously mentioned, it may act as a diluent which limits termination reactions that produce the higher molecular weight species as discussed above. It may also serve as a heat transfer media to ensure uniform heating of the waste plastics. The nature of the oil utilized in the process does not appear to be critical to many waste plastic degradation applications, but it may change the technical processing requirements. One choice is used motor oil since it, itself is a waste material. Yet other oils include but are not limited to heavy oils (that is, oils not distillable at the conditions chosen for the reactant or about 1 atmosphere pressure at up to 400° C.), fluidized bed catalytic cracker slurry oil, distillation tower vacuum bottoms, and heavy heating or bunker oil.

The stability of the oil at process conditions may impact the ability to recycle the oil as well as the amount of overhead distillate formed. Low value oils, that is oils either high in elements other than carbon and hydrogen oils of high molecular weight, particularly aromatic substances, or substances having a low hydrogen to carbon atomic ratio may also be used. This can afford a significant economic advantage as such substances are likely to be undesirable for other purposes and may be readily available at refinery sites. In addition, utilization of low value oils in the process of the present invention can create a result which basically can be characterized as combining two undesirable or waste materials to create a desirable and useful material.

As mentioned a distillate may be formed. This may include a general hydrocarbon material whose volatility allows it to become overhead vapor material under certain conditions. For the preferred embodiment, this occurs at approximately 375° C. under nominal pressure of about one atmosphere. Importantly, the products of the process may be materials which either have economic value and can be utilized in the market place, can be consumed by the process, or can be safely released to the environment.

For most situations the common range of normal volatility for distillate formed from mixed waste plastics according to this process is about 40°–375° C. Higher boiling hydrocarbon materials remain with the heavy oil. The distillate products may contain components that could be classified as value-added products (ie. toluene and styrene). These are not usually produced by the present process as pure compounds in the distillate. Instead they are likely to be present in complex mixtures with other hydrocarbon species in the preferred embodiment. Naturally, separation may be achieved to obtain these components in pure form. This may occur on site if the economics warrant. Alternatively, the distillate or products may be marketed without additional separation. The whole distillate may have market value as a feedstock to the petrochemical and refining industries. The use of these distillates or products in the refining industry is attractive because the types of compounds present indicate they might be useful as octane additives for the production of unleaded gasoline. The aromatic compounds (toluene, ethylbenzene, etc.), and the branched and cyclic structures are known to have relatively high octane numbers which can be used to enhance the octane rating of gasoline.

Five waste plastics may be considered as often included in a typical waste plastic stream. These are polyethylene (PE), polypropylene (PP), polystyrene (PS), polyethylene terephthalate (PET), and polyvinyl chloride (PVC). Thayer reported a distribution for municipal wastes of PE: 63%, PS: 11%, PP: 10%, PET: 7%, PVC: 5%, Other: 4%; See Solid Waste Concerns Spur Plastic Recycling Efforts, Chemical & Engineering News, p7, Jan. 30, 1989; hereinafter Thayer (1989). By ignoring the remaining 4%, this information produced the basis for one common mixed waste plastic experimental composition.

FIG. 1 shows a typical process system in schematic form. The raw mixed waste plastic is supplied by a first supply 10 and is fed to a mechanical chopper 11 which produces a chopped up, or comminuted, plastic material 12. This chopped mixed waste plastic 12 enters a lock hopper 20 or some mixer which may mix it with a diluent supplied by a second supply 25. It may also store the mix and meter it 21 into a solution tank 22 that is well stirred or mixed 23 (potentially continuously) and has an appropriate amount of diluent such as oil from second supply means 25 or from recycling mixed with it at about 200° C. The lock hopper 20 may include some type of star valve to prevent the escape of vapor. Further, the solution tank 20 may be utilized to assure that the plastic is solubilized in the heavy oil that is recycled to this tank from farther through the process. The oil flux through this tank may thus be maintained to allow sufficient residence time in the tank to solubilize the plastic.

The oil may be cycled through from further down the process and may additionally contain a selected amount of new oil 47. The ratio of oil to plastic may not be critical but a range of from about 2:1 to 10:1 oil to plastic appears to work. This solution of oil and plastic 24, may be stirred 23 at all times. The system may have an injected free radical precursor 32 which may enter the reaction container 41 at some solution controller 40. This may include some type of controllable valve and may also include some type of controlling logic 33. This may act to control the content of the solution to assure that it will contain a sufficient free radical content when heated so that substantially all waste plastic is decomposed. The free radical precursor 32 may be injected when needed by monitoring (such as by a sensor) and sensing (such as by a sensor) the conditions within the reaction container 41. If the overhead 43 decreases sufficiently (most likely sensed by an increase in the reactant temperature ascertained or a decrease in the amount of heat needed to maintain a given reactant temperature), it likely indicates that the relative amount of free radical precursor has dropped so more free radical precursor 32 may be automatically added. (Naturally, only the relative proportions are involved so one could conversely hold the amount of free radical precursor 32 steady and adjust the amount of waste plastic.)

Preferably the free radical precursor 32 is chosen to decompose at or below the nominal reactor temperature into some free radical or free radicals. Thus, acceptable free radical precursors include polyvinyl chloride, polyurethane, and other materials that will thermally form free radicals at temperatures at or below the reaction temperature selected. These free radical precursors may be stored is some third supply 31 until use and may even be waste plastic themselves.

The reaction container 41 may be well stirred 42 and may have entering the solution of oil, plastic, and precursor material, cycled back heavy oil 44, and some new heated oil 45. Again, the residence time in the reactor or reaction container may be maintained to maximize plastics conversion. Further, product gas may be recycled through the head space of the reactor to aid in removing volatiles from the reaction zone.

As shown, the reactor heavy oil 46 leaves and passes through a multipurpose heat exchanger or temperature controller 48 (such as a heater) where it is heated or cooled depending upon conditions of operation and leaves 49 to be pumped 50, cycled back 44, exited 51, or fed to the solution tank 22. This residual heavy oil may suffer some thermal degradation and may contain a portion of the plastic degradation that is not thermally decomposed. Thus, some heavy oil may be discharged 51 and fresh oil 47 inserted. In many instances the amount of oil or heavy oil recycled with a recycling element 44 may be in the range of approximately 70–90 percent, preferably about 80–85 percent, of the reactor fluid. Yet the process will usually work with a heavy oil recycle amount from zero to about 95 percent. Zero, or no, heavy oil recycled means a straight through flow process.

The multipurpose heat exchanger 48 may act as a regenerative heater for the fresh oil 47, which may be preheated by the recycled heavy oil entering 46 and leaving 49, before entering 45 the reaction container 41. It also may serve to heat the reactor heavy oil as heavy oil recycle 44 to keep the reaction temperature adequate. This normally has a range of about 300°–375° C. This heating operation can involve a heat source such as steam, burned fuel, fuel from the overhead gas 60, or coke and other solids formed from plastic decomposition and subsequently recovered material.

The reactor overhead 43 potentially consists of three components: a noncondensable overhead gas 60, a condensable liquid stream of overhead distillate 64 that is collected and stored 65, and condensable overhead specialty decomposition substances 66. Thus the condenser 61 or some collector means can be two-staged. The first stage may condense, perhaps in a modified cyclone arrangement, any such overhead specialty decomposition substances. These are usually solid 66, and largely come from PET degradation. The second stage may operate with cooled water 62 which then leaves 63 and condenses the overhead distillate 64, the major process product. Thus the amount of PET in the mixed waste plastic may govern how much solid is potentially present and collected. Also a small amount may be handled by becoming entrapped in the heavy oil 51. The overhead gas 60 may pass though the condenser 61 unaffected; however, before further use it can be water scrubbed to remove HCl or other halide acids.

Various equivalent flow sheets are possible and that shown in FIG. 1 is only one of many potential that could carry out the subject invention.

EXPERIMENT 1

Before mixed plastic wastes were studied, each individual component plastic was thermally decomposed to have a basis for the difference between mixed and individual resource recovery, and whether the mixed plastic wastes when thermally decomposed had an unexpected interaction.

The thermal decomposition was performed in hot fresh oil, usually at temperatures between 375° and 450° C., as a convenient substance that dissolved the plastics. Further, used or waste motor oil was a convenient fresh oil source and in itself represented a waste product. Other fresh oils that were mostly stable below 450° C. were employed such as fluidized bed catalytic cracker Slurry oil, distillation tower vacuum bottoms, and heavy heating or bunker oil. For convenience, most studies employed a simulated used or waste motor oil which was SAE 50 motor oil.

A laboratory setup was used for preliminary experimentation which consisted of a thermally regulated flask with water condenser. The flask temperature was regulated to within 5° C. and the overhead distillate condensed with 16° C. water while the amount of uncondensed overhead gas was measured. The SAE 50 oil and the appropriate plastic resin were placed into the flask and the flask was purged with nitrogen before heating began. After the proper time at temperature, the flask was quenched.

The range of temperatures was 375° to 450° C. for most plastics; however, PVC and PET were too reactive at these temperatures and their range was reduced to 285° to 360° C. The reaction time varied up to one hour in 15 minute increments.

The important individual results which varied with the type of plastic were as follows:

PE: With 75% oil and 25% PE starting and a 45 minute operating time, little overhead distillate was condensed below 425° C. but here 9.0% of the total product mix was overhead distillate. At 450° C. 28.6% was distillate indicating some of the original oil had been decomposed. Heavy oil containing some decomposition products remained in the flask. For all temperatures no measurable coke was produced and the overhead gas was less than 2.5%. For the time varying experimentation at 425° C., the overhead distillate increased with time peaking at 11.3% at one hour. A gas chromatography/mass spectrometry detailed study of the 425° C. overhead distillate indicated over 64 organic compounds and the 15% majority was classified as a mixture of $C_4$ substituted cyclopentanes.

PP: With 75% oil and 25% PP starting and a 45 minute operating time, little overhead distillate was condensed below 400° C. but here 9.5% of the total product mix was distillate. At 425° C. 14.9% was distillate with apparently minuscule oil decomposed. Heavy oil containing some decomposition products remained in the flask. For all temperatures investigated no measurable coke was produced, and the overhead gas was less than 2.0%. For the time varying experimentation at 425° C., the overhead distillate increased with time peaking at 18.6% at one hour. A gas chromatography/mass spectrometry detailed study of the 425° C. overhead distillate indicated over 55 identified organic compounds and the 5.9% majority was identified as 1,4 pentadiene with a close second at 5.3% classified as $C_4$ substituted octane.

PS: With 75% oil and 25% PS starting and a 45 minute operating time, little overhead distillate was condensed below 390° C. but here 7.0% of the total product mix was overhead distillate. At 425° C. 33.7% was overhead distillate indicating some of the oil had been decomposed. Heavy oil containing some decomposition products remained in the flask. For all temperatures no measurable coke was produced and the overhead gas was less than 1.5%. For the time varying experimentation at 400° C., the overhead distillate increased with time peaking at 18.9% at one hour. A gas chromatography/mass spectrometry detailed study of the 400° C. overhead distillate indicated over 49 identified organic compounds and the large 33.2% majority was identified as styrene.

PVC: With 89% oil and 11% PVC starting and a 45 minute operating time, little overhead distillate was condensed even at 360° C., the maximum temperature employed, but here only 1.2% of the total product mix was overhead distillate. Heavy oil containing some decomposition products remained in the flask. For all temperatures coke production increased with temperature and was 7.8% at maximum temperature. Except for HCl, overhead gas production was always minimal. HCl production was constant at 6.1% with no temperature variation and apparently most chlorine appeared in this form.

PET: With 86% oil and 14% PET starting and a 45 minute operating time, no overhead distillate was condensed. At 375° C., the maximum temperature employed, a Solid product of 7% of the total product mix was obtained, and this was likely terephthalic acid and/or benzoic acid. This solid product sublimed and collected largely in the flask neck making the material balance less accurate. Heavy oil containing some decomposition products remained in the flask. For all temperatures coke production decreased with temperature and was 15% at 325° C. but only 6% at 375° C. Overhead gas production was always minimal.

EXPERIMENT 2

A review of the tests in Experiment 1 indicated that the apparent optimum temperature for hot oil decomposition of PE and PP was about 425° C., about 400° C. for PS, about 375° C. for PET, and about 325° C. for PVC. Thus a temperature staging process was employed with mixed waste plastic, often called mixed resins. However PET was not employed in this experiment since its solid decomposition product tended to clog the apparatus. A further aspect in omitting PET was that recent trends in recycling of waste plastic have been to separate out the bottles made of PET and recycle them directly to the bottle manufacturer.

A three stage temperature experiment was performed using 270° C. for 20 minutes, 410° C. for 30 minutes, and 450° C. for 45 minutes. The oil to mixed resins ratio was ten to one. The selected reactant mixed resins were proportioned to the amounts reported by Thayer (1989). Three different combinations of oil and sweep gas were employed, SAE 50 oil with and without nitrogen sweep gas, and fluidized bed catalytic cracker slurry oil with nitrogen sweep gas. The results are presented in Table 1 where the products section for distillate was the incremental distillate produced at that temperature. The total distillate was the sum of all distillate produced during the experiment. By summing over each experiment temperature, the cumulative distillate production was obtained. The heavy oil product represented the remaining input oil plus what product compounds remained dissolved in it.

Referring to Table 1, at all temperatures much of the SAE 50 oil was decomposed, and this large amount was unexpected from the results found from the individual components in Experiment 1. Evidently a free radical which promoted decomposition was occurring for even at the lowest temperature, 270° C., the results of Experiment 1 indicated only PVC would decompose. Thus, the free radicals produced from PVC appeared to initiate the decomposition reaction of PE, PP, and PS, and as well as for the SAE 50 oil.

For the slurry oil experiment the free radical only affected the mixed resins as the slurry oil apparently did not decompose even at 450° C. Further the mixed resins essentially decomposed completely at the lowest temperature of 270° C. A further favorable aspect was that no measurable coke was formed with this slurry oil.

TABLE 1

Material Balances for the Experiments Investigating Temperature-Staged Thermal Decomposition of Mixed Plastics

| Sweep Gas | None | Nitrogen | Nitrogen |
|---|---|---|---|
| Oil | SAE 50 | SAE 50 | Slurry Oil |
| Stage I, °C. | 270 | 270 | 270 |
| Stage II, °C. | 410 | 410 | 410 |
| Stage III, °C. | 450 | 450 | 450 |
| Reactants | | | |
| Oil, g | 100.00 | 100.00 | 87.45 |
| PVC, g | 0.60 | 0.60 | 0.44 |
| Polystyrene, g | 1.20 | 1.20 | 0.97 |
| Polypropylene, g | 1.10 | 1.10 | 0.88 |
| Polyethylene, g | 7.10 | 7.10 | 5.55 |
| Total, g | 110.00 | 110.00 | 95.29 |
| Products | | | |
| Heavy Oil, g | 27.08 | 18.82 | 89.25 |
| Total Distillate, g | 74.90 | 81.04 | 5.62 |
| at 270° C. | 17.06 | 12.44 | 5.61 |
| at 410° C. | 14.95 | 33.77 | 0.01 |
| at 450° C. | 42.89 | 34.83 | 0.00 |
| Hydrochloric acid, g | 0.32 | 0.32 | 0.23 |
| Coke, g | 2.88 | 2.12 | 0.00 |
| Gas, g | 3.44 | 7.70[a] | 0.11[a] |
| Total, g | 108.62 | 110.00 | 95.21 |
| Closure, % | 98.7 | 100.00 | 99.9 |

[a]Gas production determined by difference

EXPERIMENT 3

It appears from the previous experiments that sufficient free radicals were needed to enhance the rate of decomposition at the low temperatures. Thus, if the fraction of PVC was insufficient in the mixed waste plastic to generate enough free radicals, some source of additional free radical was added. The control mechanism for the process was based upon this action. Since the decomposition reactions were highly endothermic, if insufficient free radicals were present when adequate mixed resins were dissolved, the temperature of the system rose beyond the normal targeted 375° C., and further the amount of distillate formed decreased significantly. To compensate, an additional source of free radicals was added to bring down the temperature and increase the distillate production. Extra free radical precursor up to about 10% of the waste plastic mix did not adversely affect the process.

This suggested that operating under about 375° C. was feasible to decompose the mixed resin and that the time factor was not critical. The fresh oil source is believed not crucial in many applications and apparently any available high-boiling oil that was processable by refinery operations was potentially usable.

The process can employ a wide range of input waste plastics ranging from pure PE, PP, PS, PET, and PVC, along with adequate free radical precursor added. Likewise any convenient mixture of such mixed plastics was usable as input to the process. Thayer (1989) reported that four percent of municipal waste plastic fell into an other category and was not separately identified. Yet this other category appeared processable by the subject invention since even if it did not decompose, it remained in the residual heavy oil. Further if it formed solids, recovery was with the coke and likely burned. Thus a separate group of mixed waste plastic is defined as 'other waste plastic' and consists of all other plastic types besides PE, PP, PS, PET, and PVC.

The products from this process have potential depending upon economics. These are in general overhead gas, overhead distillate, overhead specialty decomposition substances, residual heavy oil, and halide acids. The overhead distillate may potentially feed refinery stocks. Overhead gas may be burned for energy to heat the oil, or if not needed, may be flared. The halide acids, preferably hydrogen chloride, may be recovered as largely hydrochloric acid. The overhead specialty decomposition substances may be largely decompositions from PET, such as terephthalic acid and benzoic acid and may have good commercial potential if purified. The residual heavy oil and any coke may be burned. Products that are cycled back and burned to provide heat for the process are referred to as burnable products.

The foregoing discussion and the claims which follow describe a preferred embodiment of the present invention. Particularly, with respect to the claims, it should be understood that changes may be made without departing from the essence of the invention. In this regard it is intended that such changes would fall within the scope of the present invention. It simply is not practical to describe and claim all possible revisions to the present invention which may be accomplished. For instance, the claims are directed to both methods and apparatus. Although each have been included in various detail, they represent only initial claims directed toward only some basic aspects of the invention. The various permutations and combinations of the claims presented and of other aspects disclosed in the specification are intended to be encompassed within the claims and should be understood to be supported by the existing disclosure. Naturally, the disclosure of processes or methods should be construed to address apparatus utilized to achieve such processes or methods and should be construed to support a full scope of method and apparatus claims. While these may be added to explicitly include such details, the existing claims should be construed to encompass such aspects. In addition, the present disclosure should be construed to encompass subclaims similar to those presented in a process, method and apparatus context.

In addition, to the extent any revisions utilize the essence of the invention, each would naturally fall within the breadth of protection encompassed by this patent. This is particularly true for the present invention since its basic concepts and understandings are fundamental in nature and can be broadly applied. The foregoing description of the specific embodiments so fully reveal the general nature of the invention that others can, by applying current knowledge, readily modify or adapt for various applications to suit specific applications. Such embodiments will not depart from the generic concept, and therefore should be deemed to fall within the meaning and range of equivalents of the disclosed and claimed embodiments. It should also be understood that the phraseology and terminology herein is for the purpose of description and not of limitation.

We claim:

1. A system for decomposing waste plastic comprising:

a. a first, second, and third supply wherein said first supply supplies waste plastic and said second supply supplies oil;

b. a mixer responsive to at least two of said supplies;

c. a reaction container connected to said mixer and responsive to said third supply;

d. a heater connected to said reaction container, e. a collector connected to said reaction container; and f. a solution controller wherein said third supply is responsive to said solution controller.

2. A system for decomposing waste plastic as described in claim 1 wherein said oil is selected from the group consisting essentially of waste motor oil, fluidized catalytic cracker slurry oil, distillation tower vacuum bottoms, heavy heating or bunker oil, or combinations thereof.

3. A system for decomposing waste plastic as described in claim 1 wherein said heater achieves temperatures of no more than 400° C.

4. A system for decomposing waste plastic as described in claim 2 wherein said solution controller is responsive to the temperature within said reaction container.

5. A system for decomposing waste plastic as described in claim 1 wherein at least one of said supplies is adapted to assure appropriate amounts of free radical content when heated in a solution.

6. A system for decomposing waste plastic as described in claim 5 wherein at least one of said supplies is adapted to assure appropriate amounts of free radical precursor.

7. A system for decomposing waste plastic as described in claim 5 further comprising a sensor adapted to ascertain an amount of free radicals likely to be present in said solution after said solution is heated.

8. A system for decomposing waste plastic as described in claim 7 wherein said sensor is adapted to sense a reactant temperature of said solution.

9. A system for decomposing waste plastic as described in claim 1 further comprising a recycling element adapted to recycle a portion of said oil.

10. A system for decomposing waste plastic as described in claim 9 wherein said portion is from 0 to 95% of said oil.

11. A system for decomposing waste plastic as described in claim 9 wherein said portion is from 70 to 90% of said oil.

* * * * *